United States Patent [19]

Quinton

[11] Patent Number: 4,915,371

[45] Date of Patent: Apr. 10, 1990

[54] DEVICE FOR SORTING AND STACKING PAPER SECURITIES, NOTABLY BANKNOTES

[75] Inventor: Brian Quinton, Lausanne, Switzerland

[73] Assignee: De La Rue Giori S.A., Switzerland

[21] Appl. No.: 266,833

[22] Filed: Nov. 3, 1988

[30] Foreign Application Priority Data

Dec. 4, 1987 [CH] Switzerland ..... 04743/87

[51] Int. Cl.[4] ..... B65H 29/58

[52] U.S. Cl. ..... 271/280; 271/303; 271/187; 271/315

[58] Field of Search ..... 271/187, 315, 280, 303, 271/307, 214, 215, 177, 178, 223, 70, 176, 303, 184; 209/534

[56] References Cited

U.S. PATENT DOCUMENTS

| | | | |
|---|---|---|---|
| 4,222,556 | 9/1980 | Chapman et al. | 271/307 X |
| 4,461,468 | 7/1984 | Peter, III et al. | 271/308 |
| 4,506,882 | 3/1985 | Ito et al. | 271/187 X |
| 4,552,351 | 11/1985 | Tsukamoto | 271/315 X |

*Primary Examiner*—Joseph J. Rolla
*Assistant Examiner*—David H. Bollinger
*Attorney, Agent, or Firm*—Kane, Dalsimer, Sullivan, Kurucz, Levy, Eisele and Richard

[57] ABSTRACT

The device separates and stacks banknotes, that are provided with a distinguishing mark and forming part of a sequence of banknotes transported continuously in succession along a first conveyor track, and comprises a detector which reacts to the distinguishing marks and controls a deflector diverting the marked banknotes to a second conveyor track. This second track extends tangentially to the deflector in its operative condition and consists of a pair of driven endless belts contacting each other along a portion of their length. The banknotes diverted by the deflector and pinched by the nip formed between the belts in mutual contact, are transported to a stacking wheel consisting of a plurality of axially spaced disks provided with spiral-shaped slots, which receive the banknotes one after another. By means of inclined deflectors intersecting the slots the banknotes are extracted from the slots and guided into a horizontal stacking magazine where they are disposed on edge.

8 Claims, 4 Drawing Sheets

DEVICE FOR SORTING AND STACKING PAPER SECURITIES, NOTABLY BANKNOTES

This invention relates to a device for sorting and stacking paper securities, notably banknotes, for separating and stacking those paper securities which are provided with a distinguishing mark.

When printing paper securities, notably banknotes, shares or similar documents, as a rule large sheets are printed with a plurality of individual prints. These sheets are controlled visually or automatically in order to detect any misprints, the supervisor noting the mackles or spoilt sheets to be eliminated, by marking these sheets for example with fluorescent ink. Then, the sheets are cut into separate prints which are subsequently caused to travel past a detector for detecting the markings. The separate sheets are then fed to a sorting device controlled by the detector and wherein the mackles marked by the supervisor are eliminated automatically while the uncriticized prints are forwarded for undergoing a subsequent treatment, such as numbering. A device of this type is known for example from the GB Pat. No. 1,150,605.

Though all kinds of paper securities can be handled with the device of this invention, reference will be made hereinafter chiefly to banknotes for the sake of clarity.

Sorting and stacking devices are already known which utilizes, for switching the marked prints, a rotary drum provided with suction means, disposed downstream of the detector and driven at a circumferential speed synchronous with the rate of feed of the banknotes. A device of this type is disclosed for example in the DE-A No. 2,711,084 and also in the European Pat. No. 0.029,268 of which the Applicant is a joint holder. The suction drum of the second document comprises internally fixed valve plate formed with two concentric slots of circular arc configuration covering an angle of predetermined amplitude and communicating with four diametrally opposed suction nozzles, respectively. The suction nozzles open out at the drum periphery and as long as the nozzles move inside the predetermined angular space electromagnetic valves controlled for example by said detector can establish a temporary communication between one of said arcuated slots and a vacuum source for picking up the marked banknotes one by one and transferring them into a stacking magazine via suitable conveyor means. This device comprises a second suction drum engaging, and identical with, the first suction drum, and so arranged that the suction nozzles of the second drum are connected to the vacuum source at the same time as the suction nozzles of the first drum, having picked up the banknotes, are disconnected from said vacuum source, thus transferring the sheet from the first drum to the second drum. Thereafter, the sheet is transferred to a counter and caused to pass between a pair of cylinders and eventually to a conveyor belt which deposits the sheet onto a table to form vertical stacks.

It appeared that the operation of this device is attended by various inconveniences notably in the matter of speed or efficiency. The sheets conveyed along the path should travel at a high speed, namely at a rate of at least 30,000 sheets per hours, but the inertia of the system, notably of the solenoid valve control and of the means for vacuumizing the proper nozzle, makes its operation delicate and unaccurate. Moreover, a dimensional problem arises in connection with the second suction drum, the vertical stacking table requires much vertical space and the stacks obtained must be removed frequently.

It is the primary object of the present invention to palliate these inconveniences by providing a sorting and stacking device perfectly reliable at high speed and permitting a better use of the space available.

According to the present invention the device comprises a first conveyor track, along which a sequence of paper securities including those provided with a distinguishing mark is transported continuously in succession, a second conveyor track for the marked paper securities, which overlies the first conveyor track, a detector reacting to said distinguishing marks, switching means disposed after said detector in the conveyor direction, controlled by said detector and, in its operative conditions, adapted to divert the marked paper security from said first conveyor track to said second conveyor track, and a stacking magazine for the marked paper securities.

Said switching means comprises a deflector underlying the inlet end of said second conveyor track, tiltable about a horizontal axis perpendicular to the direction of, and underlying, said first conveyor track, from an inoperative condition in which said deflector is disposed beneath said first conveyor track and an operative condition in which said deflector is inclined and projects above the plane of said first track.

Said second conveyor track extends tangentially to said deflector in its operative condition, and consists of at least one pair of endless belts of which one portion bears against the other to provide a path along which said belts contact each other, each belt being supported by several rollers; at least one of said rollers is adapted to drive said belts; the initial end of said path being so close to said deflector that the paper securities diverted by said deflector are pinched by the nip formed between said belts in mutual contact.

A stacking wheel is provided at the outlet end of said second conveyor track and adapted to rotate about a shaft perpendicular to said second conveyor track and consisting of a plurality of axially spaced disks provided with spiral-shaped slots opening out at least substantially tangentially to the periphery and extending from said periphery to the centre as a prolongation of the second track for receiving the paper securities emerging from said second track. The circumferential velocity of said wheel is synchronous with the rate of feed of said paper securities (*2a*). Between said disks fixed inclined stacking deflectors intersecting said slots are provided for extracting the paper securities from said slots after an angular movement impressed to said paper securities by said wheel until they are disposed substantially vertically, and guiding said paper securities toward said stacking magazine.

The stacking magazine comprises an at least substantially horizontal bottom tray and an abutment extending upwardly substantially at right angles to said tray, said abutment plate being adapted to slide along said tray and responsive to spring means constantly urging said abutment plate toward the periphery of said wheel, and to recede when pushed by the paper securities disposed on edge and delivered by said stacking wheel.

Said second conveyor track comprises in close proximity of said deflector a curved guide plate providing a path tangential to said deflector in the operative condition thereof so as to direct the diverted paper security towards the nip formed between said pair of endless belts.

The advantages resulting from the invention are as follows: by disposing the deflector beneath the second conveyor track, just under the plane of the first conveyor track in its inoperative condition, it is possible to control very rapidly, preferably through electromechanical means, the tilting movement of this deflector when a marked banknote is detected, so that it can be switched to the second conveyor track. The smaller the angular movement of the deflector between its inoperative condition and its operative condition, the higher the speed at which this angular movement takes place. Since in the operative condition the deflector is in a tangential position at the beginning of the conveyor path, the transfer of the marked banknotes from the first conveyor track to the second conveyor track takes place rapidly and in a trouble-free manner. The fact that the stacking wheel receives the banknotes tangentially so as to set them in a substantially vertical position, the transfer of the banknotes to the stacking wheel takes place likewise rapidly and without any trouble. By stacking the banknotes on edge on an at least substantially horizontal plate it is possible to form stacks of a length greater than the height normally obtained with vertical stacks which require a frequent handling, since this height is limited by the position of the staking device in relation to the floor or to the stacking tray.

According to a preferred form of embodiment of the invention, the second track consists of at least one pair of endless belts disposed in face to face relationship and bearing against each other along at least one fraction of their length, so as to form a deflection track for the banknotes diverted by the deflector. The two belts are driven and supported by a plurality of rollers. Preferably, a curved guide plate in prolongation of the deflector in its active position is added for bringing the diverted banknote into the inlet nip formed by the belts.

A preferred form of embodiment of the invention will now be described more in detail with reference to the accompanying drawings.

Figure 1:
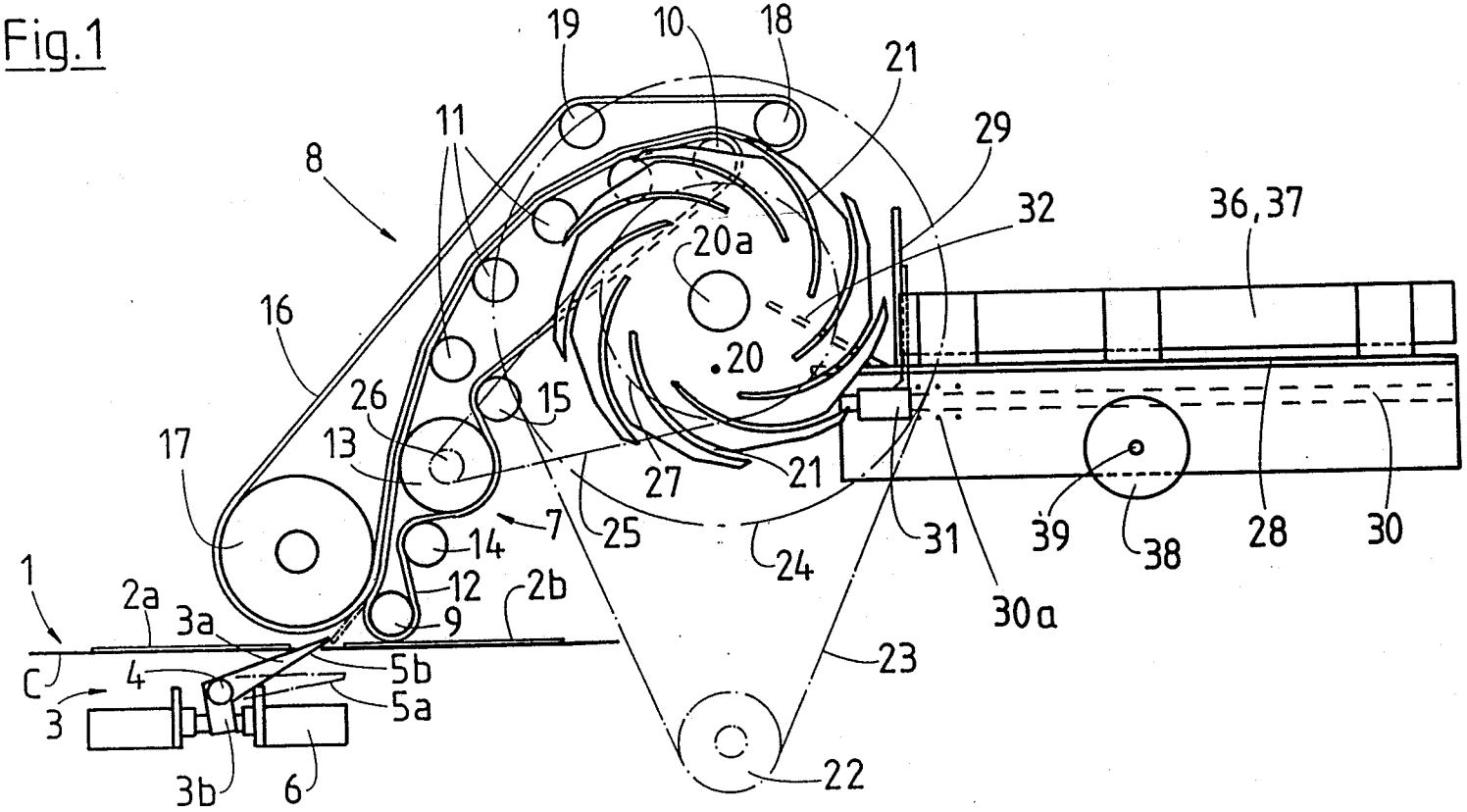
FIG. 1 is a diagrammatic side-elevational view of the equipment, with the stacking magazine empty.

The equipment comprises a first conveyor track 1 for the cut banknotes or other paper securities 2a, 2b transported as shown in FIG. 1 from left to right by a conveyor belt C provided with push buttons (not shown) and of a type known per se, for example from the EP No. 0,029,268. Underneath the plane of this first track 1 is a switching device 3 comprising a plate 3a having one end fulcrumed about a horizontal transverse pivot pin 4. This plate 3 is provided with a depending lug 3b substantially perpendicular to the plane of said plate and kinematically rigid with a bistable electromechanical device 6 controlling the tilting of said lug 3b and consequently of plate 3a between two end positions 5a and 5b. In the first position 5a (in dash lines) the plate is retracted completely under the plane of track 1 and in the second position 5b is it intersects the plane of track 1 and diverts the banknote 2a coming from the left in a tangent direction toward a second conveyor track to be described presently. The bistable electromagnetic device 6, which may also consist of any other equivalent device, is controlled by a detector (not shown) located upstream of the first conveyor track 1 and reacting when a banknote 2a marked with fluorescent ink or any other known substance moves past this detector, so as to emit a signal causing the deflector 3 to divert the marked sheet 2a toward the second conveyor track. When the banknote is engaged along this second track, the deflector is returned to its inoperative position 5a.

The second conveyor track comprising first and second endless belt conveyors 7, 8 is formed by a pair of endless belts. The first endless belt conveyor device 7 comprises two end rollers 9, 10 and between these rollers a plurality of rollers 11 supporting an endless belt 12, and also a roller 13 held in frictional driving contact with the endless belt 12. In order to warrant a tight contact on a greater surface between the belt 12 and roller 13, a pair of return rollers 14, 15 are disposed on either side of roller 13.

The second endless belt conveyor 8 comprises a belt 16 supported by a pair of end rollers 17, 18 and by an intermediate roller 19 for maintaining a clearance between the two runs of belt 16 which, in the absence of this roller 19, would contact each other due to the relative position of the two endless belt systems 7 and 8. The relative position of these systems 7 and 8 is such that the two belts 12 and 16 contact each other on a substantial portion of their length and provide a path beginning above the switching device 3, around the end rollers 9 and 17, and ending at the end rollers 10 and 18 after a curved section.

At the end of this path is a stacking wheel consisting of a plurality of disks 20 disposed in spaced axial relationship and rigidly coupled to a horizontal shaft 20a. Each disk 20 has helical slots or spiral grooves 21 formed therein which extend from its outer periphery toward the centre and constitute with the slots of the other disk a plurality of spaced apertures for receiving the banknotes leaving the second conveyor track. The end of the second conveyor track, that is, the curved path followed by the banknotes, is at least substantially tangent to the peripheral contour of the stacking disks 20 and therefore also to the inlet end of slots 21 forming an extension thereof. The stacking disks 20 are rotatably driven by means of a power pulley 22 which, via an endless belt 23, drives a second pulley 24 rigidly coupled to said horizontal shaft 20a. The endless belt 12 is driven by a second belt 25 engaging a pulley 27 keyed on shaft 20a and another pulley 26 keyed to the shaft supporting the roller 13. The ratios of the diameters of pulleys 24, 26 and 17 are calculated to set the circumferential velocity of disks 20 in synchronism with the linear velocity of the belts and therefore with the rate of feed of the banknotes transported by the endless belt systems 7, 8 which, on their side, is equal to or at least consistent with, the rate of feed of the banknotes on the first conveyor track 1. To prevent the belts from slipping on the pulleys, cogged belts and toothed pulleys are used. Thus, for example, to synchronize the circumferential speed of disk 20 with the linear speed of belts 7,8 the number of teeth of pulley 26 is 10 and the number of teeth of pulley 27 is 72, thus providing a 7.2:1 ratio, and the number of teeth of pulley 24 is 72 and the number of teeth of pulley 22 is 16, thus providing a 4.5:1 ratio. The belt 16 of belt system 8 is driven through its frictional contact with belt 12. Nevertheless, a separate power drive for belt 16 may also be contemplated.

Figure 2:
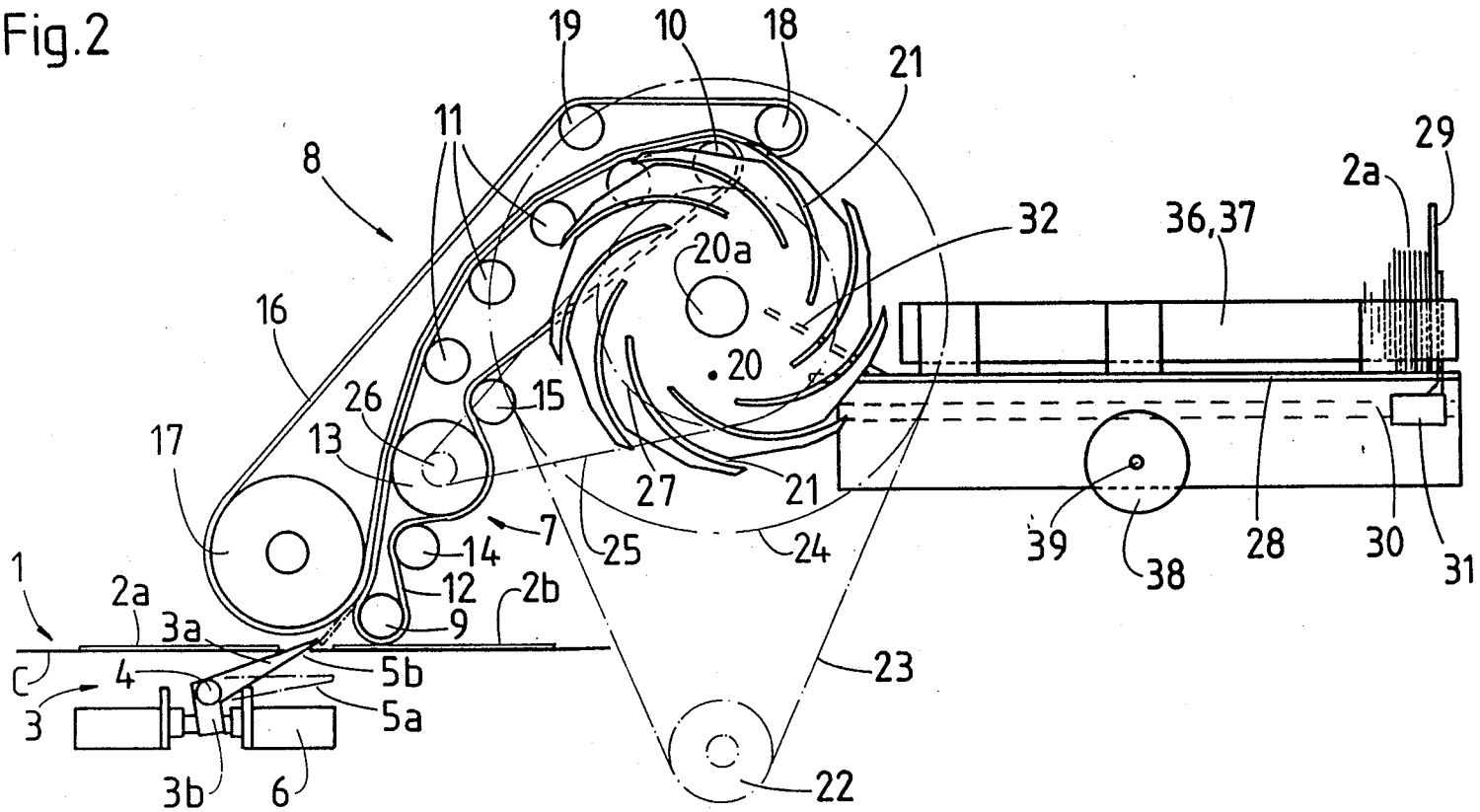
FIG. 2 is a view similar to FIG. 1 but showing the stacking magazine partially filled.

At a point located about 90 degrees beyond the outlet end of the endless belt systems 7, 8, a sheet stocking magazine associated with the stacking wheel is provided, which comprises essentially a tray 28, a plate 29 extending vertically above the tray 28 and slidably mounted on a rod 30 by means of a socket 31 responsive to a spring (not shown) urging the tray 29 toward the end of plate 28 adjacent to the stacking wheel (FIGS. 1, 2).

An inclined plate 32, disposed in front of the disks 20 and formed with fixed projecting lugs 32*a* disposed between the disks 20 and intersecting the slots 21, is adapted to pick up the banknotes from the slots 21 of disks 20, these banknotes, after being thus turned through an angle of about 90 degrees, abutting against this inclined plate 32 which prevents them from continuing their rotation with the disks 20. On the other hand, this inclined plate 32 causes the banknotes to slip in a vertical position towards the plate 29 of the stacking magazine which recedes gradually towards the opposite end of tray 28 (FIG. 2) to form a horizontal stacking of sorted banknotes.

The stacked paper securities 2*a* are held and guided laterally by means of two lateral plates 36, 37 extending at right angles to, and above, the bottom plate 28, these plates 36, 37 being spaced from and parallel to each other. The distance between these lateral plates is adjustable to correspond to the width of the paper securities by means of a wheel 38 rigidly coupled to a screw 39 engaging a pair of nuts (not shown) connected to the lateral plates 36 and 37, respectively. Thus, when rotating the wheel 38 in one direction, the plates 36, 37 move in opposite directions to adapt their positions to the width of the paper securities.

Figure 3:
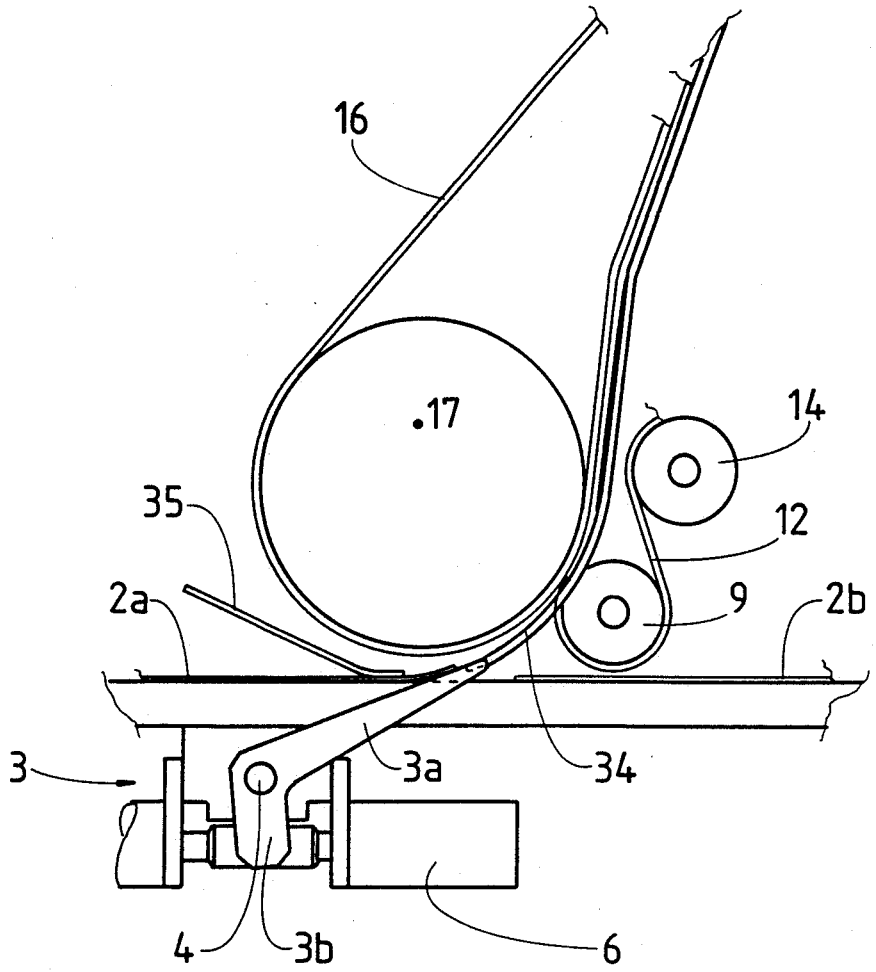
FIG. 3 shows on a larger scale the deflector and the second conveyor track.

In order to facilitate and improve the reliability and quick response of the means for switching the marked banknotes 2*a* between the two endless belts 12, 16, a guide member 34 (FIG. 3) is disposed at the level of the two end rollers 9, 17 (FIG. 3), in the form of a curved plate in the prolongation of deflector 3 when the plate 3*a* is in its operative position 5*a*, thus guiding the leading end of the banknote 2*a* lifted by plate 3*a* between the two belts 12, 16 since the registering surfaces of the two belts cannot be very close to the switching point. Likewise, to facilitate the progress of banknote 2*a* until its front end is pinched by the nip formed by the two belts 12, 16, a curved plate 35 or any other equivalent means presses this banknote against the plane of the first track 1 to prevent the banknote, due to the relative stiffness of the paper consistuting it, from loosing its contact with the conveyor system when its leading edge is lifted by plate 3*a*.

Figure 4:
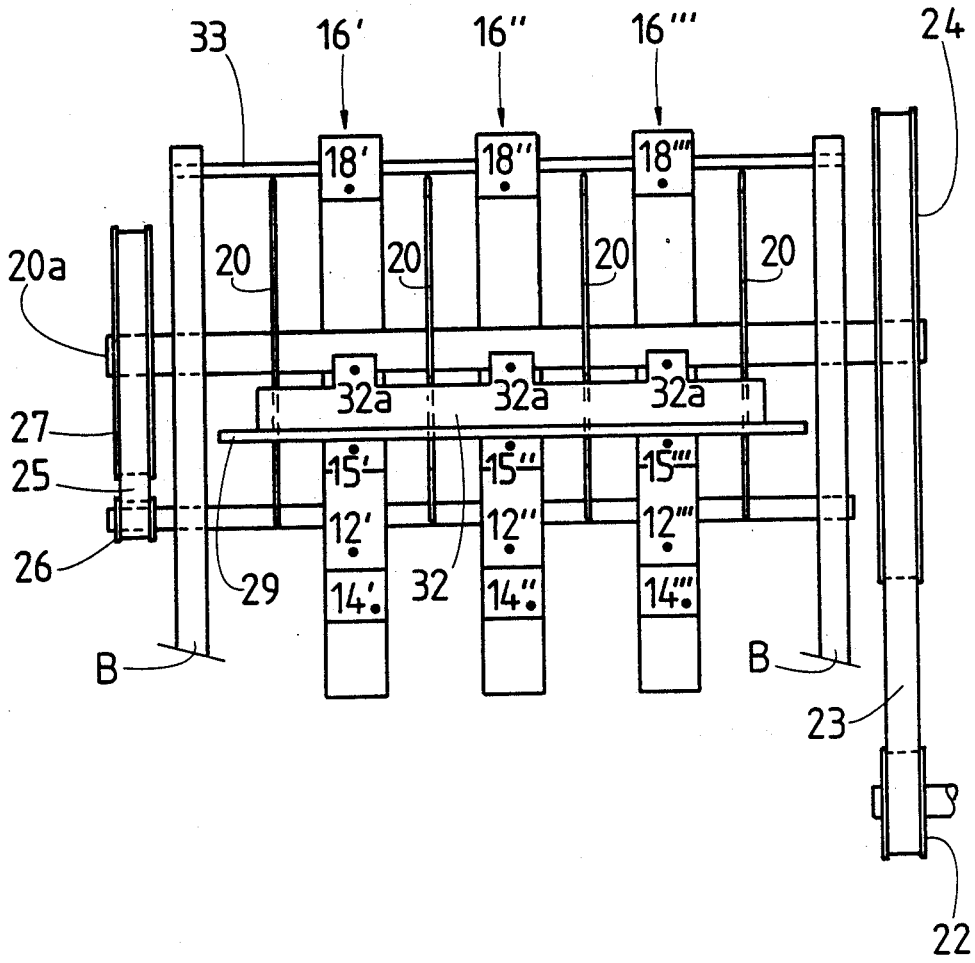
FIG. 4 is a front view of the equipment as seen from the stacking magazine side but without the stacking magazine.

FIG. 4 shows a preferred form of embodiment of the invention wherein the single pair of endless belts 12, 16 are replaced by a set of three offset belts 1', 12'', 12''' and 16', 16'', 16''' driven and supported by a corresponding number of rollers in a manner similar to the arrangement of FIG. 1. FIG. 4 shows the end rollers 18', 18'', 18''' rotatably mounted on a shaft 33 supported by the frame structure 8 of the machine. On the other hand, FIG. 4 also shows the rollers 15', 15'', 15''' and 14', 14'', 14''', respectively.

In the same view, the shafts of the other rollers (except shafts 20*a* and 33) are not shown for the sake of clarity.

I claim:

1. A device for sorting and stacking paper securities (2*a*, 2*b*), notably banknotes, for separating and stacking those paper securities which are provided with a distinguishing mark and forming part of a sequence of paper securities transported continuously in succession along a first conveyor track (1), which comprises a second conveyor track (7, 8) for the marked paper securities (2*a*) which overlies the first conveyor track (1), a detector reacting to said distinguishing marks, switching means (3) disposed after said detector in the conveyor direction, controlled by said detector and, in its operative conditions, adapted to divert the marked paper security (2*a*) from said first conveyor track (1) to said second conveyor track (7, 8), together with a stacking magazine (28–31) for the marked paper securities (2*a*), characterized in that:

said switching means comprises a deflector (3*a*) underlying the inlet end of said second conveyor track (7, 8), tiltable about a horizontal axis (4) perpendicular to the direction of, and underlying, said first conveyor track (1), from an inoperative condition (5*a*) in which said deflector is disposed beneath said first conveyor track (1) and an operative condition (5*b*) in which said deflector is inclined and projects above the plane of said first rack (1), said second conveyor track (7, 8) extends tangentially to said deflector (3*a*) in its operative condition, the second conveyor track (7, 8) consisting of at least one pair of endless belts (12, 16) of which one portion bears against the other to provide a path along which said belts (12, 16) contact each other, each belt (12, 16) being supported by several rollers (9, 10, 11, 13, 14, 17, 18, 19), and that at least one (13) of said rollers is adapted to drive said belts (12, 16), the initial end of said path being so close to said deflector (3*a*) that the paper securities (2*a*) diverted by said deflector are pinched by the nip formed between said belts in mutual contact (12, 16); the second conveyor track (7, 8) comprises in close proximity of said deflector (3*a*) a curved guide plate (34) providing a path tangent to said deflector (3*a*) in the operative condition thereof so as to direct the diverted paper security (2*a*) towards the nip formed between said pair of endless belts (12, 16), stacking wheel is provided at the outlet end of said second conveyor track (7, 8) and adapted to rotate about a shaft (20*a*) perpendicular to said second conveyor track (7, 8) and consisting of a plurality of axially spaced disks (20) provided with spiral-shaped slots (21) opening out at least substantially tangentially to the periphery of the stacking wheel and extending from said periphery of the stacking wheel to the centre as a prolongation of the second track (7, 8) for receiving the paper securities (2*a*) emerging from said second track (7, 8), that the circumferential velocity of said wheel is synchronous with the rate of feed of said paper securities (2*a*), that between said disks fixed inclined stacking deflectors (32*a*) intersecting said slots (21) are provided for extracting the paper securities from said slots after an angular movement impressed to said paper securities by said wheel until they are disposed substantially vertically, and guiding said paper securities toward said stacking magazine (28, 29, 30, 31, 36, 37), said stacking magazine comprises an at least substantially horizontal bottom tray (28) and an abutment (29) extending upwardly substantially or right angles to said tray (28), said abutment plate being adapted to slide along said tray and responsive to spring means constantly urging said abutment plate toward the periphery of said wheel, and to recede when pushed by the paper securities disposed on edge and delivered by said stacking wheel.

2. The device according to claim 1, further comprising a device (35) being provided upstream of said deflector (3a) for pressing said paper security (2a) against the top surface of said first conveyor track (1).

3. The device according to claim 1, characterised in that the stacking magazine further comprises two lateral plates (36, 37) extending at right angles to, and above, the bottom plate (28), said lateral plates being spaced from and parallel to each other and intended for holding laterally the stacked paper securities, and that their relative spacing is controlled by means of a wheel (38) rigidly coupled to a screw (39) engaging a pair of corresponding nuts rigidly coupled in turn to said plates (36, 37) respectively.

4. The device according to claim 1, characterised in that the movement of said deflector (3a) is controlled by an electromechanical device (6).

5. The device according to claim 1, characterised in that said belts (12, 16) of said pair of conveyor tracks are cogged, and that the rollers supporting and driving said belts are provided with corresponding teeth.

6. A device for sorting and stacking paper securities (2a, 2b), notably banknotes, for separating and stacking those paper securities which are provided with a distinguishing mark and forming part of a sequence of paper securities transported continuously in succession along a first conveyor track (1), which comprises a second conveyor track (7, 8) for the marked paper securities (2a) which overlies the first conveyor track (1), a detector reacting to said distinguishing marks, switching means (3) disposed after said detector in the conveyor direction, controlled by said detector and, in its operative conditions, adapted to divert the marked paper security (2a) from said first conveyor track (1) to said second conveyor track (7, 8), together with a stacking magazine (28–31) for the marked paper securities (2a), characterized in that:

said switching means comprises a deflector (3a) underlying the inlet end of said second conveyor track (7, 8), tiltable about a horizontal axis (4) perpendicular to the direction of, and underlying, said first conveyor track (1), from an inoperative condition (5a) in which said deflector is disposed beneath said first conveyor track (1) and an operative condition (5b) in which said deflector is inclined and projects above the plane of said first track (1), said second conveyor track (7, 8) extends tangentially to said deflector (3a) in its operative condition, the second conveyor track (7, 8) consisting of at least one pair of endless belts (12, 16) of which one portion bears against the other to provide a path along which said belts (12, 16) contact each other, each belt (12, 16) being supported by several rollers (9, 10, 11, 13, 14, 17, 18, 19), and that at least one (13) of aid rollers is adapted to drive said belts (12, 16), the initial end of said path being so close to said deflector (3a) that the paper securities (2a) diverted by said deflector are pinched by the nip formed between said belts in mutual contact (12, 16); the second conveyor track (7, 8) comprises in close proximity of said deflector (3a) a curved guide plate (34) providing a path tangent to said deflector (3a) in the operative condition thereof so as to direct the diverted paper security (2a) towards the nip formed between said pair of endless belts (12, 16), a device (35) being provided upstream of said deflector (3a) for pressing said paper security (2a) against the top surface of said first conveyor track (1), stacking wheel is provided at the outlet end of said second conveyor track (7, 8) and adapted to rotate about a shaft (20a) perpendicular to said second conveyor track (7, 8) and consisting of a plurality of axially spaced disks (20) provided with spiral-shaped slots (21) opening out at least substantially tangentially to the periphery of the stacking wheel and extending from said periphery of the stacking wheel to the centre as a prolongation of the second track (7, 8) for receiving the paper securities (2a) emerging from said second track (7, 8), that the circumferential velocity of said wheel is synchronous with the rate of feed of said paper securities (2a), that between said disks fixed inclined stacking deflectors (32a) intersecting said slots (21) are provided for extracting the paper securities from said slots after an angular movement impressed to said paper securities by said wheel until they are disposed substantially vertically, and guiding said paper securities toward said stacking magazine (28, 29, 30, 31, 36, 37), said stacking magazine comprises an at least substantially horizontal bottom tray (28) and an abutment (29) extending upwardly substantially or right angles to said tray (28), said abutment plate being adapted to slide along said tray and responsive to spring means constantly urging said abutment plate toward the periphery of said wheel, and to recede when pushed by the paper securities disposed on edge and delivered by said stacking wheel, the stacking magazine further being comprised of two lateral plates (36, 37) extending at right angles to, and above, the bottom plate (28), said lateral plates being spaced from and parallel to each other and intended for holding laterally the stacked paper securities, and that their relative spacing is controlled by means of a wheel (38) rigidly coupled to a screw (39) engaging a pair of corresponding nuts rigidly coupled in turn to said plates (36, 37) respectively.

7. The device according to claim 6, characterized in that the movement of said deflector (3a) is controlled by an electromechanical device (6).

8. The device according to claim 6 characterized in that said belts (12, 16) of said pair of conveyor tracks are cogged, and that the rollers supporting and driving said belts are provided with corresponding teeth.

* * * * *